United States Patent [19]

Ishikawa et al.

[11] Patent Number: 4,937,608

[45] Date of Patent: Jun. 26, 1990

[54] PHOTOGRAPHIC PROCESSING APPARATUS

[75] Inventors: Takatoshi Ishikawa, Kanagawa; Shigemi Saito, Tokyo; Kazuaki Yoshida, Kanagawa; Yoshihiro Fujita, Kanagawa, all of Japan

[73] Assignee: Fuji Photo Film Co., Ltd., Kanagawa, Japan

[21] Appl. No.: 393,745

[22] Filed: Aug. 15, 1989

[30] Foreign Application Priority Data

Aug. 19, 1988 [JP] Japan ..... 63-205879

[51] Int. Cl.[5] ..... G03D 3/06; G03D 3/08

[52] U.S. Cl. ..... 354/324; 354/299; 354/322

[58] Field of Search ..... 354/299, 320, 321, 322, 354/324; 430/30

[56] References Cited

U.S. PATENT DOCUMENTS

| | | | |
|---|---|---|---|
| 4,240,737 | 12/1980 | Lawson | 354/299 |
| 4,329,042 | 5/1982 | Libicky et al. | 354/324 |
| 4,600,287 | 7/1986 | Hotta et al. | 354/299 |
| 4,829,330 | 5/1989 | Yamada et al. | 354/322 |
| 4,839,683 | 6/1989 | Kushima et al. | 354/322 |

*Primary Examiner*—A. A. Mathews

*Attorney, Agent, or Firm*—Sughrue, Mion, Zinn, Macpeak & Seas

[57] ABSTRACT

In a photographic processing apparatus for immersing and developing an exposed light sensitive material in a developer contained in a developing tank, the temperature of the developer is detected and an evaporation amount of the developer corresponding to an elapsed time period is estimated on the basis of the temperature detected. Then, a replenishment water is supplied to the developing tank by the amount based on this estimated evaporation amount. Consequently, an optimum concentration of the developer in the developing tank can be maintained, thereby preventing a change in the developing characteristics.

19 Claims, 5 Drawing Sheets

| Xo mℓ | LESS THAN 20 | 20 ~ 50 | 50 ~ 100 | 100 ~ 150 | OVER 150 |
|---|---|---|---|---|---|
| Xp mℓ | 0 | 50 | 100 | 150 | 200 |

PHOTOGRAPHIC PROCESSING APPARATUS

BACKGROUND OF THE INVENTION

1. Field of the Invention

This invention relates to a photographic processing apparatus for developing a light sensitive material, in particular a photographic processing apparatus that makes allowance for replenishment of an evaporated part of a developer.

2. Description of the Related Art

In carrying out developing with a photographic processing apparatus, after exposure a light sensitive material is inserted into a tank filled with a developer and then fed to at least one of a desilverisation tank (bleaching, fixing, etc.) a washing tank and a stabilizing tank.

At the time of transport of the light sensitive material to the next process treatment tank from the developing tank, developer attached to the light sensitive material is carried out of the developing tank and the developer in the developing tank is deteriorated due to contact of the same with air. For these reasons, a predetermined amount of replenishment solution must be added to the developing tank. In addition to this, the developer temperature is generally maintained at a predetermined temperature which is higher than the outside temperature in order to maintain a predetermined developing efficiency, consequently evaporation rate is increased. An operator must therefore keep checking to see whether or not are developer surface is maintained in a constant level range, and supply replenishment water as the developer evaporates. In general since a replenishment amount of the replenishment water is generally 20 to 300 ml per day, the replenishment is troublesome for the operator, and also, if there is a large drop in the developer surface level, a change in the developer concentration can arise causing a deterioration in the developing capacity of the developer.

In particular, when the developer is a color developer containing a p-phenylenediamines color developing agent which is an aromatic primary amine (for example, N-ethyl-N-(β-methane sulfone amido ethyl)-3-methyl-4-aminoaniline, 4-(N-ethyl-N-β-hydroxyethylamino)-2-methyl aniline, etc.), an occurrence of a photographic fog is likely and also changes of photographic qualities occur easily especially in accordance with an enrichment of the developer. Accordingly, it is desirable to provide a method of preventing changes in concentration of the developer.

It is an object of the present invention, taking the above into consideration, to provide a photographic processing apparatus that can accurately estimate the amount of evaporation from the surface of the developer and replenish the developing tank with water.

SUMMARY OF THE INVENTION

To achieve the above object, a photographic processing apparatus of the present invention, which is for developing process conducted by immersing an exposed light sensitive material in a developer received in a developing tank, includes a device for detecting the temperature of the developer, a device for estimating the evaporation amount of the developer and a device for supplying replenishment water to the developing tank. The estimation device estimates the amount of evaporation of the developer corresponding to an elapsed time on the basis of the developer temperature, and the supply device supplies replenishment water to the developing tank on the basis of the amount of evaporation estimated by the estimation device.

In the above arrangement of the present invention, since the amount of evaporation of developer corresponding to the elapsed time is estimated and the replenishment water is supplied to the developing tank on the basis of the estimated evaporation amount, the concentration of the developer in the developing tank can be suitably maintained.

As one way, the replenishment water may be supplied to the developing tank by the amount corresponding to the evaporation amount obtained by the estimation device wherein the evaporation amount estimated is unmodified. As another way, it is also possible to predetermine a plurality of replenishment water amounts convenient for handling replenishment water for the estimated evaporation amount, and then determine the necessary replenishment water amount among them. Such a replenishment water amount can be set at a plurality of values, for example, at 50 ml intervals, and the value closest to the evaporation amount estimated by the estimation device can be chosen from the plurality of values.

This estimation device may be constituted such that a table is made by measuring beforehand developer evaporation amounts corresponding to developer temperatures and the developer evaporation amount is obtained from this table. This table can be made by taking into account an ambient temperature at the location where the photographic developing apparatus is installed, that is to say a room temperature, and an ambient humidity, that is to say a room humidity, etc., as well as the developer temperature. Also, if the developer temperature is obtain, then the developer evaporation amount corresponding to the developer temperature for that season can also be established beforehand. The supply device can be operated at any time in a period after the photographic processing apparatus is stopped and before it is re-started. In particular, if the supply device is operated at the time of re-starting of the photographic processing apparatus, the replenishment water can be supplied in the amount which contains the developer evaporation amount of the developer not only in the period of operation of the photographic processing apparatus but also after the photographic developing apparatus is stopped.

DESCRIPTION OF THE PREFERRED EMBODIMENT

Figure 1:
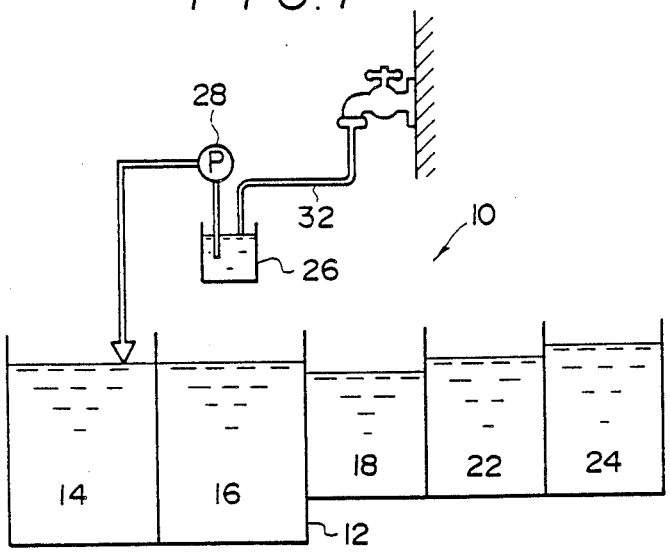
FIG. 1 is a schematic view of a preferred embodiment of a photographic processing apparatus to which the present invention is applied.

A photographic processing apparatus 10 of a preferred embodiment of the present invention, as shown in FIG. 1 has a main tank 12 divided by a plurality of partition walls into a developing tank 14, a bleaching/fixing tank 16, and washing tanks 18, 22, 24.

The developing tank 14 is filled with a developing processing solution (developer) which has adjusted to a predetermined concentration. The developing agent of this developer is a P-phenylenediamines color developing agent which is an aromatic primary amine. The bleaching/fixing tank 16 is filled with a bleaching/fixing processing solution, and the washing tanks 18, 22, 24 are filled with washing processing water (solution). Also each of the processing tanks is provided with a usual conveying device (not shown) consisting essentially of gripping conveying rollers for taking out a light sensitive material after insertion in each of the processing solutions and conveying it to the next process. Accordingly, development processing is carried out by immersing the light sensitive material after an image has been exposed, successively in these processing tanks.

Figure 6:
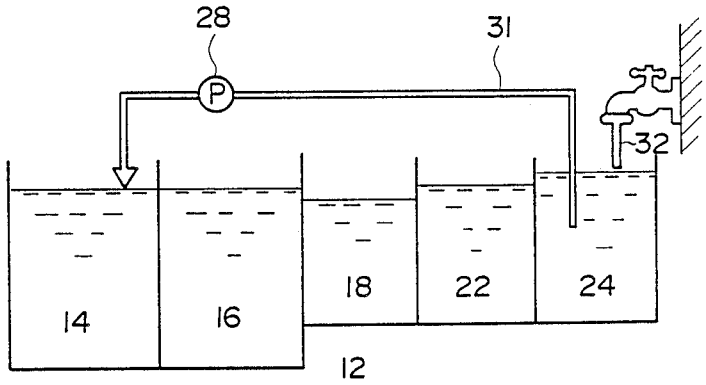
FIG. 6 is a schematic illustration showing a situation with supply of water from a final washing tank.

A replenishment tank 26 is arranged for the developing tank 14 and by a pump 28 the necessary amount of replenishment water is supplied to the developing tank 14. Tap water for replenishment water is supplied to this replenishment tank 26 beforehand through a pipe 32. Instead of the pump 28, it is possible to fit a valve to the pipe 32 and by opening and closing this valve, replenishment water can be supplied to the developing tank 14. Alternatively, the washing water for the washing tanks 18–24 can be supplied to the developing tank 14 as the replenishment water. In this case, as shown in FIG. 6, supplying from the final washing tank 24 overcomes the fear of mixing the bleaching/fixing solution with the developer. In FIG. 6 a pipe 31 is for replenishment water supply.

Figure 2:
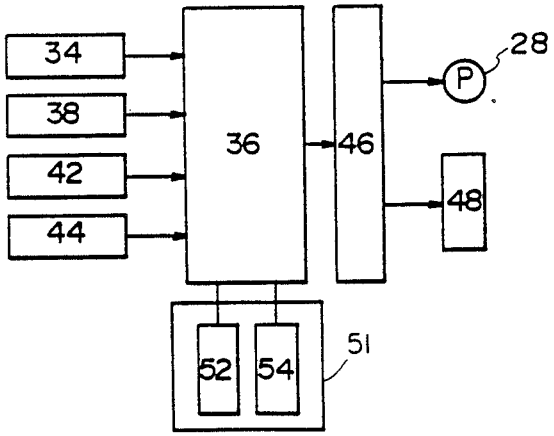
FIG. 2 block diagram showing a control equipment and thereto of the preferred embodiment.

Inside the developing tank 14 is provided a temperature sensor 34 indicated in FIG. 2. The temperature sensor 34 detects the developer temperature and sends a detection signal to a control device 36. The control device 36 can be composed of a micro-computer. Also in the room where the processing apparatus 10 is set up is provided a room temperature sensor 38 for detecting the ambient temperature in the room (room temperature) and a room humidity sensor 42 for detecting the ambient humidity in the room (room humidity), and the sensors 38 and 42 send detection signals to the control device 36 in the same manner as the temperature sensor 34. The room temperature sensor 38 and room humidity sensor 42 can be attached to the outside of the main tank 12.

A start switch 44 is connected to the control device 36. By turning the start switch 44 on, through a drive circuit 46, a process drive section 48 can be driven. This process drive section 48 has the gripping conveying rollers (not shown) for conveying the light sensitive material successively in the respective processing tanks, a temperature control heater (not shown) for regulating a set temperature of the developer in the developing tank 14, and so on.

Figures 4A, 4B:
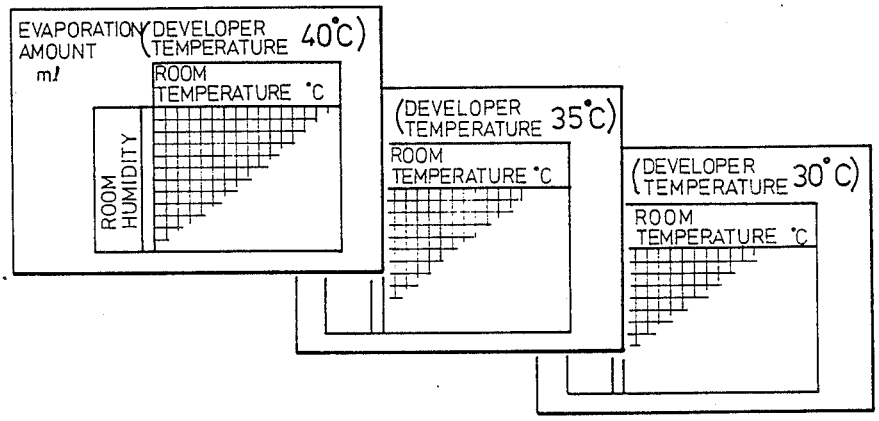
FIG. 4(A) is a schematic view showing tables for obtaining the water evaporation amount of a developer, based on developer temperatures, room temperatures, and room humidities.
FIG. 4(B) is a table for selecting the necessary determined replenishment water amount Xp corresponding to the summed evaporation amount Xo.

As shown in FIG. 2, a memory device 51 is connected to the control device 36. In the memory device 51 is stored a table 52 of determined developer evaporation amounts and a table 54 of determined replenishment water amounts. The developer evaporation amounts of the table 52, as shown schematically in FIG. 4(A), are determined to correspond to developer temperatures, room temperatures and room humidities. In the tables shown in FIG. 4(A), the developer evaporation amounts per unit time (e.g. per hour) when the developer temperature is at a predetermined temperature (e.g. 30° C., 35° C., 40° C.) are determined corresponding to the room temperatures and room humidities. The control device 36 calculates at unit time intervals (e.g. 1 hr.) the evaporation amount of water per unit time in the developing tank 14 from the table 52 on the basis of the developer temperature and the temperature and humidity of the room in which the photographic processing apparatus 10 is located.

At this time, as the developer temperature, room temperature and room humidity, either average values within the unit time or values at any time within the unit time can be used.

Figure 5:
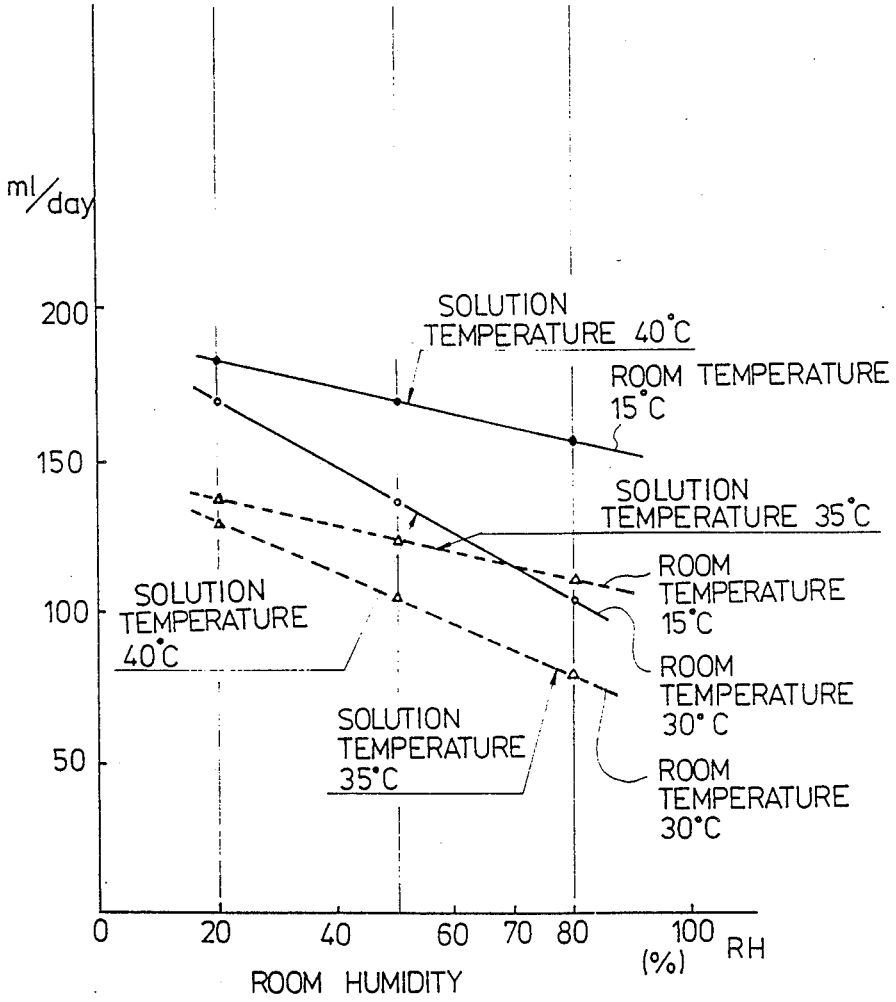
FIG. 5 is a graph showing the water evaporation amounts of the developer in one day corresponding to room temperatures, room humidities and developer temperatures.

The evaporation amounts of the table 52 are obtained from the graph of FIG. 5 showing the evaporation amount. FIG. 5 is obtained from actual measurement of the evaporation amount from a 100 $cm^2$ developer surface in contact with air over 1 day (ml/day), depending on the developer temperature, room temperature, and room humidity (relative humidity). Based on the graph of FIG. 5, the data of FIG. 4(A) is determined. Accordingly, as a substitute for the table 52 it is possible to have a memory device storing the graph shown in FIG. 5 or the equations for calculating the evaporation amounts shown in FIG. 5, and connected to the control device 36.

The developer evaporation amount, as can be seen from FIG. 5, increases as the room humidity decreases, irrespective of the room temperature and developer temperature. If the developer temperature is fixed, then irrespective of the room humidity, the developer evaporation amount increases as the room temperature decreases. If the room temperature is fixed, then irrespective of the room humidity, the developer evaporation amount increases, as the developer temperature increases. It is to be noted that the rates of increase of the evaporation amount in these cases are different from each other. Accordingly, the respective tables for the respective different developer temperatures shown in FIG. 4(A) are set up so that, the evaporation amount increases as the room humidity decreases, and the evaporation amount increases as the room temperature decreases.

Since the above room temperature and room humidity have an almost fixed correspondence with the seasons, the evaporation amount corresponding to the developer temperature for each season can be determined. Also the evaporation amount can be determined to correspond to the developer temperature and room temperature.

In the table 54, as shown in FIG. 4(B), the assortment of the total evaporation amounts for a certain lapse of time Xo and the established replenishment water amounts Xp corresponding to the total evaporation amounts Xo is determined. The control device 36 operates the pump 28 through the drive circuit 46 to supply the replenishment water to the developing tank 14 by the established replenishment water amount Xp relevant to the total evaporation amount Xo calculated.

Figure 3:
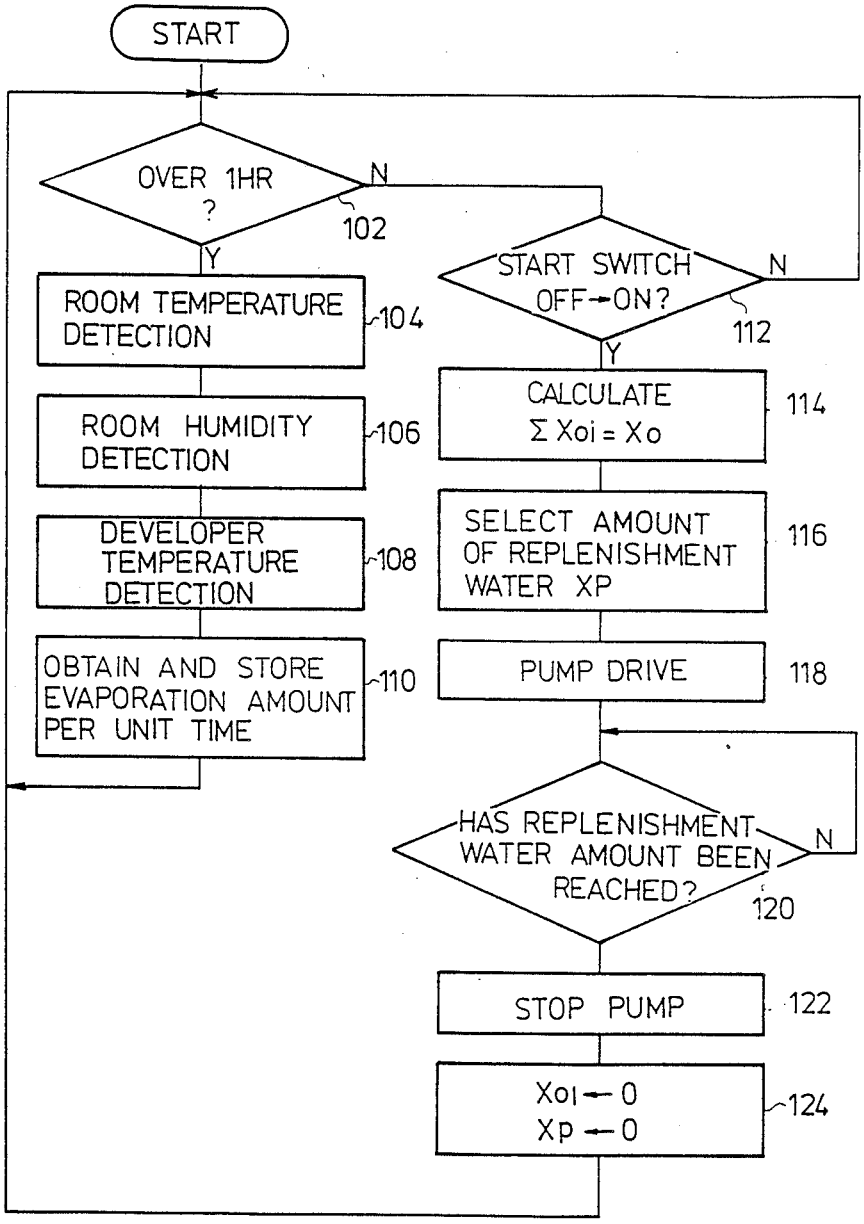
FIG. 3 is a flow chart showing an operation of the preferred embodiment.

Next, according to FIG. 3, a supply procedure for the replenishment water based on this preferred embodiment will be explained.

In step 102 it is determined whether or not unit time has elapsed, for example whether of not one hr. has elapsed. In this preferred embodiment, with unit time as 1 hour, the evaporation amount of water in the developer is obtained for every hour of elapsed time. Of course it is possible to have unit time of other than 1 hour in this invention.

When it is determined that 1 hour has elapsed, in step 104 the room temperature detected with the room temperature sensor 38 is input in the control device 36, and in step 106 the room humidity detected with the room humidity sensor 42 is input in the control device 36. Then, in step 108 the developer temperature detected with the developer temperature sensor 34 is input in the control device 36. In step 110, based on these inputs, the evaporation amount Xoi after one hour lapse of time is obtained from the table 52 and stored in the memory device 51. At this time, since the tables are established at predetermined intervals of the developer temperature (in the example of FIG. 4(A) the tables are established at 5° C. intervals, the evaporation amount is obtained from the table of the developer temperature closest to the developer temperature input in step 108. In the photographic processing apparatus 10, even after completion of the processing operation by turning the start switch 44 OFF, the evaporation amount Xoi is obtained every hour. Accordingly, regardless of whether or not the processing apparatus 10 is operated, the evaporation amount every unit time is stored.

In step 102 when it is determined that one hour has not elapsed yet, it is determined whether or not the start switch 44 which has been put in the OFF condition is switched ON in step 112. When the start switch 44 is switched ON, the processing apparatus 10 is operated and in step 114 the hourly evaporation amount Xoi is summed so that the total evaporation amount Xo is obtained. In the case that the start switch 44 continues to be ON or OFF the program returns to step 102. In this way the total evaporation amount Xo of the sum of the evaporation amounts per unit time until the start switch is switched ON can be calculated. In step 116 the established replenishment water amount Xp relevant to the total evaporation amount Xo is selected using the table 54.

In step 118, the pump 28 is operated, and in step 120 it is determined whether or not the discharge amount of the pump 28 has reached the replenishment water amount Xp. The pump 28 is then stopped in step 122. Since the discharge amount per pump revolution or per unit time of the pump 28 is preliminarily known, a replenishment water of the same amount as the replenishment water amount Xp can be accurately supplied to the developing tank 14 by measuring the number of revolutions or operating time of the pump 28.

In the next step 124, all of the evaporation amounts Xoi for each hour and the total evaporation amount Xo are cleared and the procedure returns to step 120.

As a result, the developer evaporation amount for each unit time is obtained, and at the time of starting the processing apparatus the evaporation amounts are summed so that a replenishment water amount corresponding to the summed total amount is obtained. Then, a replenishment water is supplied to the developing tank 14 by the replenishment water amount obtained.

In the preferred embodiment, thus, when the start switch 44 is operated so that the processing operation is put in the condition to be re-started, the total evaporation amount of water from the developer up to that time is estimated, and since the replenishment water is supplied to the developing tank 14 on the basis of this total amount estimated, the total amount estimated is considered so as to be the amount evaporated not only during operation of the processing apparatus 10 but also during non-operating period thereof. Further since the developer heater is off during the non-operating period of the processing apparatus 10, the evaporation amount is relatively small. For this reason, after turning the start switch 44 off, the unit time in step 102 is increased as compared with that when the developing operation is continuous. Also, in step 118 of the above preferred embodiment, it is possible to supply the replenishment water to be developing tank 14 by the amount equal to the total evaporation amount Xo obtained in step 116 by the pump 28 using the total evaporation amount Xo without modifying it to the established replenishment water amount Xp.

The supply of the replenishment water may be conducted by the pump 28, at the time when the processing apparatus is switched off by the start switch 44, by the total evaporation amount up to that time or the established replenishment amount selected from the table 54 on the basis of the total evaporation amount. For this reason, when it is detected that the start switch 44 is switched off from on, the program may proceeds to step 114.

In the above preferred embodiment, the measurements of the room temperature and the room humidity conducted by the room temperature sensor 38 and the room humidity sensor 42 can be omitted, and the evaporation amount can be computationally estimated on the basis of only the developer temperature. In this case it is possible to obtain in advance the evaporation amounts corresponding to the developer temperature occurring in the respective spring, summer, autumn, and winter seasons or monthly periods, etc., and construct an estimation table of the developer evaporation amount. Since the developer evaporation amount for the seasons changes depending on each region, the estimation table can be prepared separately for each respective region.

The above description concerns an apparatus for carrying out developing, bleaching/fixing and washing, that is, an apparatus for processing of photographic paper. However, the present invention is not limited to only this and can be applied to an apparatus for carrying out developing, bleaching, bleaching/fixing, washing, and stabilizing etc., that is an apparatus for processing of film. These apparatus are also usually provided with drying section.

What is claimed is:

1. A photographic processing apparatus for immersion and development treatment of an exposed light sensitive material in a developer contained in a developing tank comprising;

first means for detecting the temperature of the developer;

second means for estimating an evaporation amount of the developer corresponding to an elapsed period of time on the basis of at least the developer temperature; and third means for supplying to said developing tank a replenishment water of the amount based on the evaporation amount estimated by said second means.

2. A photographic processing apparatus according to claim 1, further comprising;

fourth means for detecting an ambient temperature at a location where said photographic processing apparatus is installed, so that said second means estimates the evaporation amount of the developer corresponding to the elapsed period of time on the basis of the developer temperature and the ambient temperature.

3. A photographic processing apparatus according to claim 1, further comprising:

fifth means for detecting an ambient temperature at the location where said photographic processing apparatus is installed; and sixth means for detecting an ambient humidity at said location so that said second means estimates the evaporation amount of the developer corresponding to the elapsed period of time on the basis of the developer temperature, the ambient temperature and the ambient humidity.

4. A photographic processing apparatus according to claim 1, wherein said second means is constituted to estimate the evaporation amount of the developer per unit time on the basis of the developer temperature and sum the evaporation amounts of the developer per unit time to estimate a total evaporation amount of the developer corresponding to the elapsed period of time.

5. A photographic processing apparatus according to claim 1, wherein said third means is constituted to supply the replenishment water to said developing tank by the same amount as the amount of the replenishment water obtained on the basis of the evaporation amount of the developer estimated by said second means.

6. A photographic processing apparatus according to claim 1, further comprising:

first memory means storing beforehand a first table of evaporation amounts of the developer per unit time corresponding to the developer temperatures, said second means being constituted to look up said first table to estimate the evaporation amount of the developer per unit time corresponding to the developer temperature and sum the evaporation amounts of the developer per unit time to estimate a total evaporation amount of the developer corresponding to the elapsed period of time.

7. A photographic processing apparatus according to claim 2, further comprising:

first memory means storing beforehand a first table of evaporation amounts of the developer per unit time corresponding to the developer temperatures and the ambient temperatures, said second means being constituted to look up said first table to estimate the evaporation amount of the developer per unit time corresponding to the developer temperature and the ambient temperature and sum the evaporation amounts of the developer per unit time to estimate a total evaporation amount of the developer corresponding to the elapsed period of time.

8. A photographic processing apparatus according to claim 3, further comprising:

first memory means storing beforehand a first table of evaporation amounts of the developer per unit time corresponding to the developer temperature, the ambient temperature and the ambient humidity, said second means being constituted to look up said table to estimate the evaporation amount of the developer per unit time corresponding to the developer temperature, the ambient temperature and the ambient humidity and sum the evaporation amounts per unit time to estimate a total evaporation amount of the developer corresponding to the elapsed period of time.

9. A photographic processing apparatus according to claim 6, wherein the evaporation amounts of the developer per unit time stored in said first memory means are prescribed for the developer temperatures corresponding to each season.

10. A photographic processing apparatus according to claim 6, wherein the evaporation amount of the developer per unit time stored in said first memory means is prescribed to increase as the developer temperature rises.

11. A photographic processing apparatus according to claim 7, wherein the evaporation amount of the developer per unit time stored in said first memory means is prescribed to increase as the ambient temperature for each of different developer temperatures decreases.

12. A photographic processing apparatus according to claim 8, wherein the evaporation amount of the developer per unit time memorized in said first memory means is prescribed to increase as the ambient humidity for each of the different developer temperatures becomes low and increase as the ambient temperature for the each of the different developer temperatures becomes low.

13. A photographic processing apparatus according to claim 1, further comprising:

second memory means storing beforehand a second table of replenishment water amounts corresponding to the evaporation amounts of the developer, said third means being constituted to supply the replenishment water to said developing tank by the same amount as the replenishment water amount corresponding to the evaporation amount estimated by said second means through said second table.

14. A photographic processing apparatus according to claim 1, wherein said second means is constituted to always estimate the evaporation amount of the developer corresponding to the an elapsed period of time on the basis of the developer temperature regardless of whether or not said photographic processing apparatus is put in an operating condition, and said supply means is constituted to supply to said developing tank the replenishment water of the amount based on the evaporation amount of the developer estimated by said second means at the time when said photographic processing apparatus is put into the operating condition from a non-operating condition.

15. A photographic processing apparatus according to claim 1, wherein said second means is constituted to always estimate the evaporation amount of the developer corresponding to the elapsed period of time on the basis of the developer temperature regardless of whether or not said photographic processing apparatus is put in an operating condition, and said supply means is constituted to supply to said developing tank the replenishment water of the amount based on the evaporation amount of the developer estimated by said second means at the time when said photographic processing apparatus is put into a non-operating condition from the operating condition.

16. A photographic processing apparatus according to claim 1, wherein said second means is constituted to obtain an average value of the developer temperature detected by said first means to estimate the evaporation amount of the developer corresponding to the elapsed period of time on the basis of the average value.

17. A photographic processing apparatus according to claim 1, wherein tap water is used as the replenishment water.

18. A photographic processing apparatus according to claim 1, further comprising a plurality of washing tanks for washing the light sensitive material developed in said developing tank arranged in series, a wash water from a final washing tank is used as the replenishment water.

19. A photographic processing apparatus according to claim 1, wherein the developer contains a P-phenylenediamines color developing principal agent.

* * * * *